US006501380B1

(12) United States Patent
Jakobsson

(10) Patent No.: US 6,501,380 B1
(45) Date of Patent: Dec. 31, 2002

(54) PROBABILISTIC THEFT DETERRENCE

(75) Inventor: Bjorn Markus Jakobsson, Hoboken, NJ (US)

(73) Assignee: Lucent Technologies Inc., Murray Hill, NJ (US)

( * ) Notice: Subject to any disclaimer, the term of this patent is extended or adjusted under 35 U.S.C. 154(b) by 0 days.

(21) Appl. No.: 09/710,182

(22) Filed: Nov. 10, 2000

(51) Int. Cl.[7] ..... G08B 13/14

(52) U.S. Cl. ..... 340/571; 340/568.1; 340/5.85; 380/25; 380/4; 713/202

(58) Field of Search ..... 340/571, 565.1, 340/5.85; 380/25, 4, 9, 23, 30; 395/2.82; 713/202, 200, 201

(56) References Cited

U.S. PATENT DOCUMENTS 4,908,608 A * 3/1990 Reinke et al. ..... 340/571
5,317,304 A * 5/1994 Choi ..... 340/571
5,355,414 A * 10/1994 Hale et al. ..... 380/25
5,578,991 A * 11/1996 Scholder ..... 340/571
5,748,084 A * 5/1998 Isikoff ..... 340/568.1
5,757,271 A * 5/1998 Andrews ..... 340/568.1
5,760,690 A * 6/1998 French ..... 340/571
5,960,085 A * 9/1999 De La Huerga ..... 380/25
6,189,105 B1 * 2/2001 Lopes ..... 713/202

* cited by examiner

*Primary Examiner*—Benjamin C Lee
(74) *Attorney, Agent, or Firm*—Walter J. Tencza, Jr.

(57) ABSTRACT

A protected device is provided which may normally operate in a first state of normal operation. A first event may cause the protected device to go into a second state of alert where the protected device still operates normally but additionally provides warnings to a user. For example, during the second state of alert a user may be warned that an access code needs to be entered to prevent degradation or altering of the operation of the protected device. The first event may be triggered or may depend on one or more sub-events some of which may occur with some probability and some of which may automatically occur or may be deterministic. If a second event occurs prior to the user providing an access code then the protected device would transition from the second state (normal operation with warnings) to a third state in which the operation of the protected device would be altered or degraded. The second event may be based on one or sub events some of which may be probabilistic and some of which may be deterministic. If the user enters the correct access code during either the second state (warnings) or the third state (altering or degradation of operation), then the protected device would go back to the first state (normal operation, no warnings and no degradation).

27 Claims, 4 Drawing Sheets

PROBABILISTIC THEFT DETERRENCE

FIELD OF THE INVENTION

This invention relates to improved methods and apparatus of providing theft protection particularly for electronic or optical devices.

BACKGROUND OF THE INVENTION

Given that devices, such as electronic or optical devices, are becoming smaller and smaller, and more common in society, it is likely that theft of such devices will be an increasing problem for consumers, and insurance companies. Theft is motivated by the anticipated value of the device to a thief, or to a person who buys the device from the thief. Therefore, a mechanism that lowers the anticipated value of a stolen device without lowering the value to its rightful owner will work as a theft deterrence.

Traditional theft deterrence mechanisms are typically visible (e.g., locks, inscriptions of the owner's name, etc). These traditional mechanisms have at least two drawbacks. Firstly, if they can be removed (such as a lock), then a buyer of the stolen merchandise can verify that the article does not have the protection. Secondly, if the mechanism cannot practically be removed (such as an inscription of the owner's name) then this may lower the value of the device to the rightful owner, as it may reduce his ability to honestly resell the device.

SUMMARY OF THE INVENTION

The present invention in one or more embodiments provides a mechanism for disabling or altering the normal operation of a protected device if a code, such as an access code or a personal identification number, is not entered by a user after being requested by the protected device or by a central device. The protected device may periodically and/or randomly, with some probability, request entry of the code to continue normal operation. The invention may be thought of as providing "invisible" protection against theft of protected devices, which may be for example electronic or optical devices. A potential purchaser of a potentially stolen protected device, will be less likely to purchase, if there is a high probability that the device will eventually disable itself, unless a proper code is entered. In this manner the present invention in several embodiments generally reduces the value of the protected device to a thief, but not to a rightful owner.

The protected device may normally operate in a first state of normal operation. A first event may cause the protected device to go into a second state of alert where the protected device still operates normally but additionally provides warnings to a user. For example, during the second state of alert a user may be warned that an access code needs to be entered to prevent degradation or altering of the operation of the protected device. The first event may be triggered or may depend on one or more sub-events some of which may occur with some probability and some of which may automatically occur or may be deterministic.

If a second event occurs prior to the user providing an access code then the protected device would transition from the second state (normal operation with warnings) to a third state in which the operation of the protected device would be altered or degraded. The second event may be based on one or sub events some of which may be probabilistic and some of which may be deterministic. If the user enters the correct access code during either the second state (warnings) or the third state (altering or degradation of operation), then the protected device would go back to the first state (normal operation, no warnings and no degradation).

In one or more embodiments the present invention provides an apparatus comprising means for altering the operation of a protected device and means for receiving an access code. The means for altering the operation of the protected device alters the operation of the protected device if the access code is not received prior to an occurrence of a particular event. The apparatus may be further comprised of means for providing one or more warnings prior to the occurrence of the particular event, wherein each warning indicates that the operation of the protected device will be altered unless the access code is provided to the means for receiving the access code. Warnings may be provided in a random manner when, for example, a randomly generated numbers falls within a first range.

The present invention in one embodiment discloses an apparatus comprising a memory; a processor; a user interface device, and an operation controlling mechanism. The operation controlling mechanism controls the operation of a protected device. The protected device may for example be a computer, a cellular telephone, a camera, a television, a compact disc player, a Personal digital assistant ("PDA"), for example a PALM PILOT (trademarked), or a video cassette recorder.

The processor may provide a warning to a user that the operation of the operation controlling mechanism will be altered unless an access code is entered into the user interface device. The access code may be, for example, a password or a personal identification number ("PIN"). If the access code is not entered into the user interface device, the processor alters the operation of the operation controlling mechanism and thereby alters the operation of the protected device. The processor may provide randomly periodic or periodic warnings to the user that the operation of the operation controlling mechanism will be altered unless a code is entered in the user interface device. The warnings may be generated when a periodically randomly generated number falls within a given range.

The operation of the protected device may be altered or degraded in a gradual fashion. For example, if the user does not enter the correct access code prior to a first event (such as within twenty-four hours) then one of the functions of the protected device may be disabled (such as the rewind function of a video cassette recorder. If the user further does not enter the correct access code prior to a second event (such as within forty-eight hours after the first warning), then the entire protected device may be completely disabled.

In one embodiment, a central device may alter service for a protected device. For example a central device may prevent long distance calls from a particular cell phone device (which in this example would be the protected device), unless an access code is entered into the cell phone.

Generally, the access code or personal identification code ("PIN") may be stored in memory in the protected device. The access code may be changed by a user having knowledge of the code. The access code may also be stored in a central device in the case where a central device alters service for the protected device.

DETAILED DESCRIPTION OF THE DRAWINGS

Figure 1:
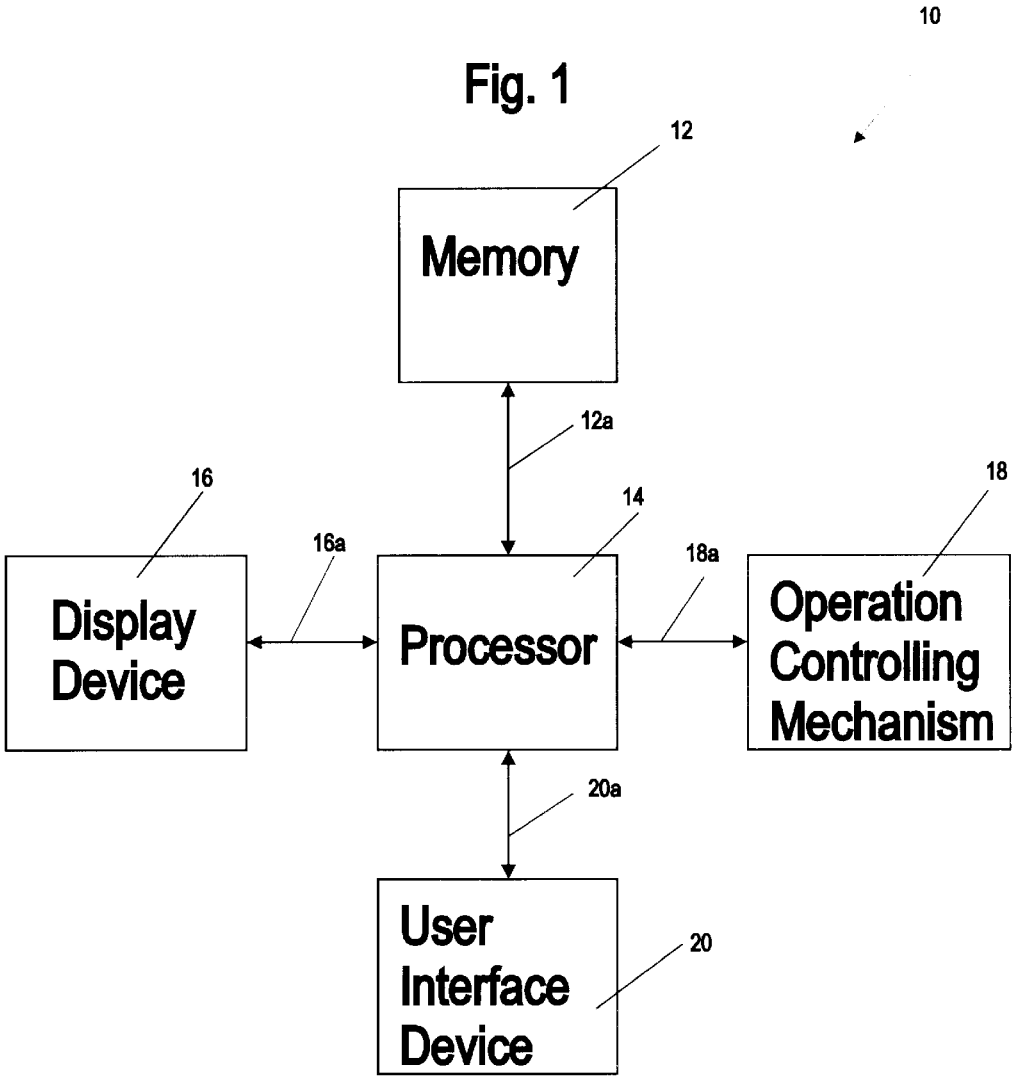
FIG. 1 shows a diagram of an apparatus for accomplishing theft deterrence in accordance with an embodiment of the present invention.

FIG. 1 shows a diagram of an apparatus 10 for accomplishing theft deterrence for a protected device in accordance with an embodiment of the present invention. The apparatus 10 is comprised of a memory 12, a processor 14, a display device 16, an operation controlling mechanism 18, and a user interface device 20. The apparatus 10 may be part of a protected device which may be an electronic or optical device, such as a camera, a computer, or a compact disc ("CD") player and the operation controlling mechanism 18 may control one or more operations of the protected device. The memory 12, display device 16, operation controlling mechanism 18, and user interface device 20 are electrically connected to the processor 14 by the busses 12*a*, 16*a*, 18*a* and 20*a*, respectively. Busses 12*a*, 16*a*, 18*a* and 20*a* may be wireless electrical connections.

The apparatus 10 may have three different modes of operation. In the first mode, the processor 14 may periodically generate a random number and compare the random number to a triggering range. For example, assume the processor 14 generates the random number "3" out of the possible random numbers "1" through "100". Assume the triggering range in this example is "0" to "3". Since "3" is within the triggering range of "0" to "3" the processor 14 will cause the second mode of operation to be executed. On the other hand if the random number generated is not in the triggering range, the processor 14 will continue for some time in the first mode, and after a certain period of time the processor 14 will select another random number and compare the new random number to the triggering range. The processor 14 will continue generating random numbers and comparing random numbers to the triggering range in the first mode, until a generated random number is within the triggering range. Thus, the second mode will be entered after some random period of time, some random number of uses, or some random number of certain events.

When a generated random number is within the triggering range, the second mode operation of apparatus 10 begins. In the second mode of operation the processor 14 causes a warning message to be displayed on the display device 16. The warning message indicates that a user must enter an access code into the user interface device 20 or the operation of the operation controlling mechanism 18 will be altered (and thus the operation of protected device 100 of FIG. 2). The warning message may indicate that the code must be entered within a certain amount of time in order to avoid altering or stopping the operation controlling mechanism 18. The amount of time may be a randomly generated amount of time generated by the processor 14. The amount of time may be based on a state of the protected device 100 which is operated by operation controlling mechanism 18, so that while it is not necessarily perfectly random, it is difficult for a user to determine the state or the amount of time before the operation of operation controlling mechanism 18 will be altered.

Alternatively, the access code may have to be entered within a certain number of usage's of the protected device 100, such as a random number of usage's which may be generated by the processor 14. The number of usage's before the operation is altered after "triggering occurs" may be based on a "state" of the protected device 100 and while not actually random, may be difficult for a user to determine.

In any case, a counter in memory 12, would typically be set after triggering by the processor 14. The counter would begin to count down, for example with time, or with each particular usage. For example, the counter may count down every time the stop button 106 of the protected device 100 is pressed, or every certain random number of times the stop button 106 is pressed, with the random number again generated by processor 14.

If the user enters the access code into user interface device 20 at any time prior to the counter in memory 12 counting down to zero, the apparatus 10 (and therefore the consumer device 100 of FIG. 2) will go back to the first mode or normal operation. The processor 14 receives the access code via bus 20*a* and checks whether the access code is the correct code. The processor 14 may compare the code entered by the user into the user interface device 20 with a correct access code stored in memory 12. The processor 14 upon receiving the correct code (prior to the counter counting down) may cause the counter to be reset, for example to eleven, and to discontinue counting down.

If the counter has counted down to zero and the user has not entered the appropriate access code, the processor 14 will enter the third mode and cause the operation controlling mechanism 18 to alter the operation of the apparatus 10 and thus the protected device 100. A signal or signals may be sent from the processor 14 to the operation controlling mechanism 18 to cause the operation of the protected device 100 to be altered. For example, the protected device 100 may be a compact disc ("CD") player. In that case, the processor 14 may send signals to the operation controlling mechanism 18 to cause the protected device 100 to be disabled so that it can no longer play CDs.

Instead of completely shutting off the protected device 100, the processor 14 may cause a first degradation after a first event (which may be a period of time) which may be for example the disablement of the volume operation of the protected device 100. If the access code is not entered after a second or further event (which may be a further period of time) the processor 14 may cause a further degradation which may be for example the disablement of the play operation of the protected device 100.

The apparatus 10 could be part of a different protected device, such as for example a telephone. A signal or signals may be sent from the processor 14 to the operation controlling mechanism 18 to cause the operation of the telephone to be altered. For example, the signals from processor 14 may prevent any phone calls from being made. Similarly the signals from the processor 14 may prevent only non-emergency calls from being made.

The apparatus 10 could also be part of a camera. In that case, the processor 14 may send signals to the operation controlling mechanism 18 which may cause a "Please Notify Police" message to be added to each photo taken in the same manner that dates are added to photos. This message would be placed in photographs only if the correct access code is not entered prior to the occurrence of a first event (such as, for example, the passage of a period of time or the occurrence of a number of usage's of the camera).

The operation controlling mechanism 18 and the processor 14 may be incorporated in a single processor. I.e. the single processor may both control the operation of the protected device, such as the protected device 100 of FIG. 2, and control the modification or cessation of that operation. Power up or power down of the protected device 100 may be less of a concern in such a case.

Figure 2:
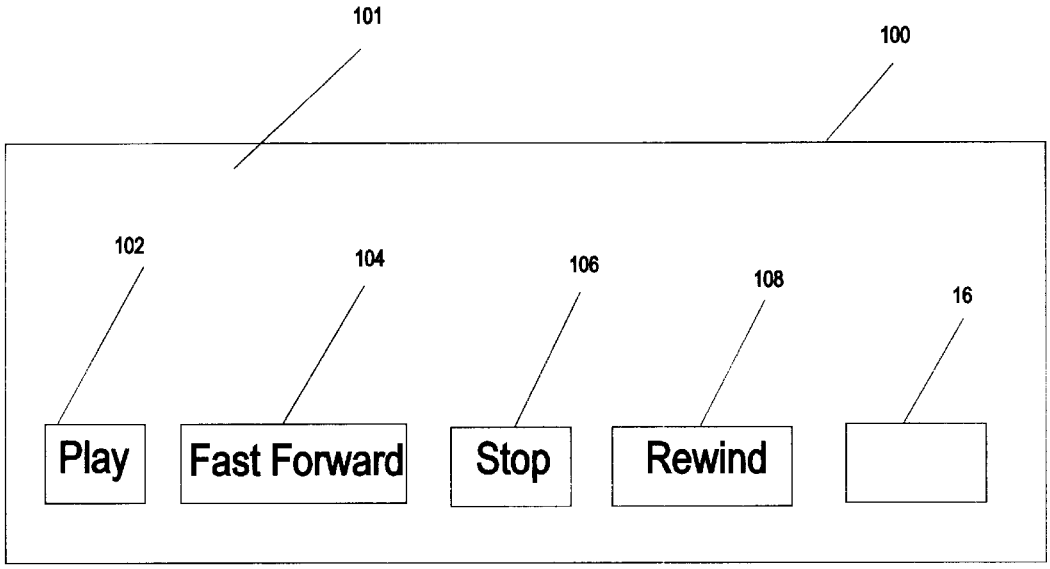
FIG. 2 shows a diagram of a front panel of a compact disc player including keys for operating the compact disc player.

FIG. 2 shows a front panel 101 of the protected device 100, which in this case is a compact disc player. The compact disc player is an example of a protected device whose operation can be altered. The protected device 100 includes a 'play' button 102, fast forward button 104, stop button 106, a rewind button 108, and a display device 16. The buttons 102, 104, 106, and 108 may be part of the user interface device 20 of FIG. 1. The protected device 100 includes the memory 12, the processor 14 and the operation controlling mechanism 18 as shown in FIG. 1.

If the operation controlling mechanism 18 controls a protected device 100 which is a compact disc player, as in FIG. 2, then each time the protected device 100 is started, the processor 14 may generate a random number which may depend on the state of the protected device 100. The state of the protected device 100 may be for example the state of any register in the electronics of the protected device 100 or any timing information, information about how likely the altering of the operation should be, or a counter about how many compact discs can be played. For example, in some existing compact disc players when the power is turned off, the compact disc player keeps track of the place where the compact disc player was stopped. Then when the compact disc player is turned on the compact disc player begins playing from where it stopped. This is an example of a "state" of the protected device 100.

The processor 14 may check to see if the randomly generated number is within the triggering range and may cause a message to be displayed on display device 16 if that is the case, stating that the protected device 100 will for example, lock, unless the access code is entered into the user interface device 20. The processor 14 may generate a random number for the event within which the compact disc player 100 will lock. The processor 14 may generate the number ten, but not display that the number, indicating that the protected device 100 will lock, after ten compact discs are played, unless the correct access code is entered into user interface device 20.

In the memory 12, which may be in the protected device 100, there may be a counter whose value normally is eleven. Prior to a triggering event occurring, the counter is not changed, but rather remains at eleven. When the randomly generated number is within the triggering range, the counter may be changed from eleven to ten. The memory 12 may be flash RAM, or similar memory that is not erased when the power of the compact disc player is shut off. Every time a user presses the 'play' button 102, (or every random number of times) on the protected device 100, the counter in memory 12 is decreased, unless the counter has a value of eleven or zero. If the counter in memory 12 has been reduced to zero when the user presses the 'play' button 102, then the processor 14 causes the operation controlling mechanism 18 to disable the play function. I.e. the compact disc player 100 cannot be used. If the protected device 100 runs on a battery or batteries and if the batteries are replaced, the counter may go to zero as a result. Note that this is not a way to disable the security mechanism. Note also that it may not take place, depending on the amount of time memory can hold the state without being connected to the battery source. Once the counter reaches zero, independently of the reason, the personal identification number (PIN) or the password code may need to be entered to allow playing of the protected device 100.

If at any time before the counter in memory 12 reaches zero, the user presses a certain combination of keys on the panel 101 of the protected device 100 in FIG. 2 (such as 'play' 102, 'play' 102, 'fast forward' 104, 'stop' 106 'play' 102, 'stop' 106, 'stop' 106, and 'play' 102) that is unique to this particular compact disc player 100 (and printed in the warranty documents) then the counter in memory 12 is reset to 11. In this case the keys 102, 104, 106, and 108 would be part of the user interface device 20. The counter will not count down in this case when it is set to 11. Alternatively, if the user loses the warranty information, for the protected device 100, he may call the manufacturer and be sent a written description of the combination of keys to press to stop the processor 14 from altering the operation of the operation controlling mechanism 18. The user may need to read the serial number of the protected device 100 over the phone, or a number printed in the warranty documents. The ability to be sent a written description of the combination of keys may be blocked if the protected device 100 is reported stolen. This feature may encourage product registration (important for the manufacturer for marketing purposes) by tying the code-by-phone service or password by phone service to the registration of the protected device 100. It is possible to sell protected devices that do not have theft protection initially, but are enabled to have it. This means that the theft protection can be obtained as a service from the manufacturer. It is possible for the manufacturer to give the user a certain device-specific access code after the service has been paid for; this access code, when entered, enables the theft protection. For example, apparatus 10 of FIG. 1 may not have theft protection initially. The user may need to enter the access code into user interface device 20 in order to enable theft protection. The operation previously described for FIG. 1 (i.e. the generation of random numbers and the possible altering of the operation of the operation controlling mechanism 18) may then take place. The protection may then last for the lifetime of the device, or may be limited in time. After the time of theft protection has ended, the device may lock and require the PIN to be entered, thus preventing a thief from merely having to wait until the expiry of the protection period.

It is possible to implement conflict resolution mechanisms (such as UN-registering a device as stolen—if the original registration was by mistake or joke, or the device was found after being registered stolen) by sending the password or code (i.e. the combination of keys to hit on the compact disc player 100) to the claimant and reporting the ownership of the device to the police. (This is likely not to bother an honest user, but worry a thief or the client of a thief.)

The protected devices operated in accordance with embodiments of the present invention may include modems which may not receive a password via an input or interface device that is part of the protected device itself, but rather could receive a password through a computer attached to the modem.

In the above, randomness can be generated by storing a state, such as the state of a register or counter in the electronics of a typical compact disc player, in memory 12 and modifying the state in memory 12 according to environment parameters (such as the bits read from a compact disc for a compact disc player embodiment; the shutter speed used for a certain picture for a camera embodiment; the bits communicated through a modem, for a modem embodiment). The function used for the above may be a one way function or some other function for combining inputs. The "random properties" required from the "random generator" are not very strong, but largely amount to an unpredictability to humans who cannot probe the device, but only observe it. The probability with which the operation of the operation controlling mechanism 18 of the protected device, such as the protected device 100, is shut-off, altered, or locked can be set by selecting what interval of random values will cause a shut-off, altering or locking.

A software solution could be activated when some correct password is presented. As above, the solution may have a "time delay" to avoid service degradation to rightful owners. If the protected device has an online connection it may be that the unlock mechanism would verify that the protected device is not reported stolen, and reply with the correct unlock code if the protected device is not stolen. This online unlock can also be employed for cellular telephones, cellular PDAs, etc. A protected device may be caused to degrade or have its operation changed locally in accordance with the present invention or may be caused to degrade in a more central manner. For example, cell phone service may be degraded by a central location which prevents long distance telephone calls. If a smart card is the protected device, a central or online computer may cause the secret encryption key on the smart card to be erased so the smart card can not be used.

It may be more appropriate to alter the functionality of a protected device rather than completely shutting it off. A phone, for example, could instead of locking all phone calls be made only to lock non-emergency calls; a computer could be made to notify the manufacturer of its internet protocol ("IP") address and location (if inferred from information processed by the computer); a camera protected device may add "PLEASE NOTIFY POLICE" to each photo in the same manner as dates are currently added to photos by some cameras.

Figure 3:
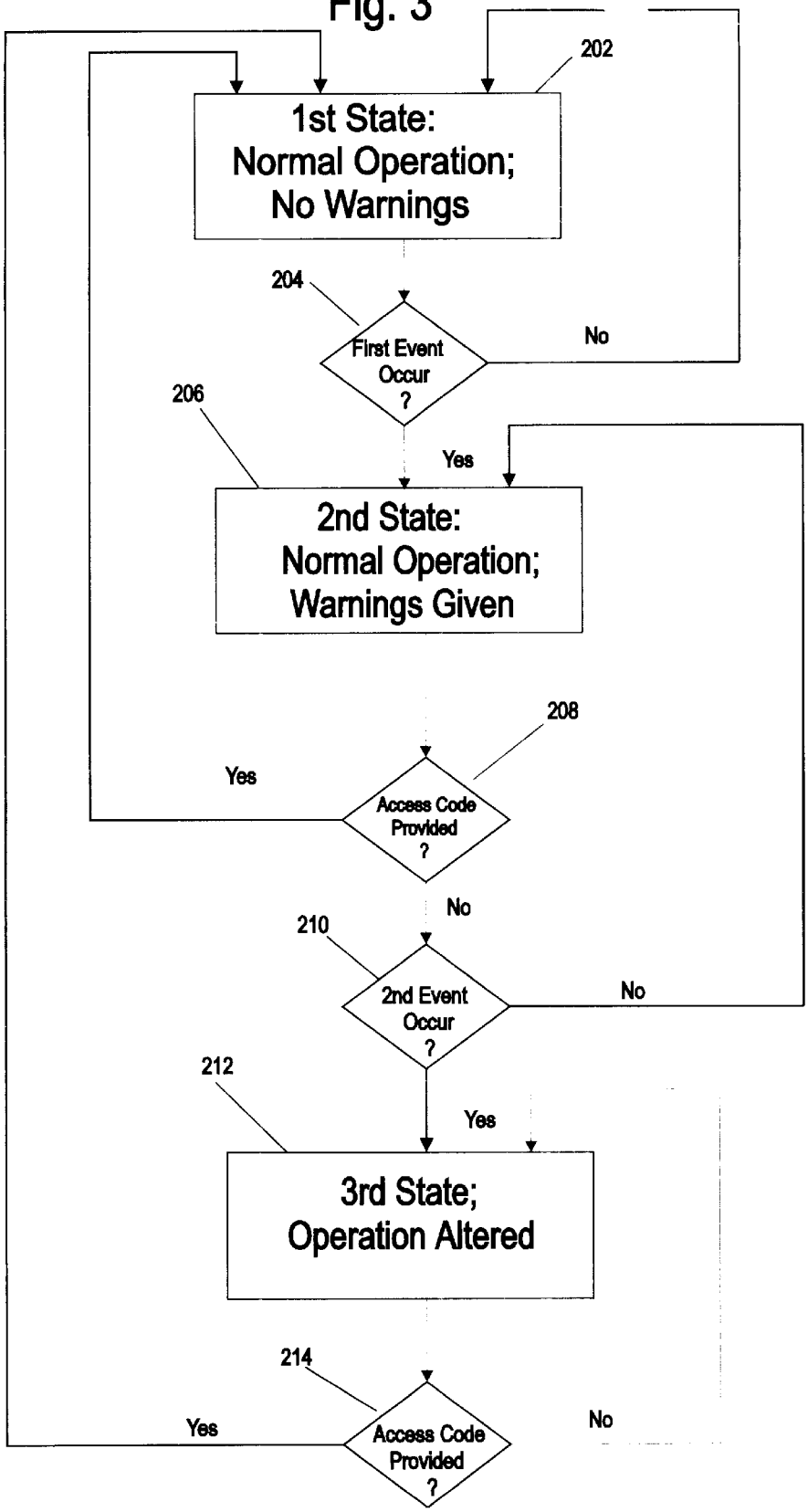
FIG. 3 shows a flow chart of a method of another embodiment of the present invention.

FIG. 3 shows a flow chart 200 of a method in accordance with an embodiment of the present invention. Step 202 shows the execution of the first state of protected device 100. During the first state the protected device 100 is in normal operation and no warnings are provided. At step 204 the processor 14 of FIG. 1 determines whether a first event has occurred. If the first event has not occurred then the protected device 100 remains in the first state, i.e. normal operation with no warnings being provided. If the first event has occurred then the method proceeds to step 206 where the second state is executed. During the second state the protected device 100 still operates normally, however, warnings are given to a user to indicate that an access code must be entered to continue normal operation. If the access code is provided at step 208 the method proceeds back to the first state at step 202, where there is again normal operation with no warnings. If the access code is not provided, the processor 14 checks to see if a second event has occurred. If a second event has not occurred then the method continues at step 206 in the second state and further warnings are given.

If the second event has occurred the method proceeds to step 212 where the third state is executed. During the third state the operation of the protected device 100 is altered. The processor 14 may continue to check whether the access code is provided during the third state at step 214. If the correct access code is entered, the processor 14 will again cause the first state to be executed at step 202. If the correct access code is not entered the third state may be continued until the correct access code is entered.

Figure 4:
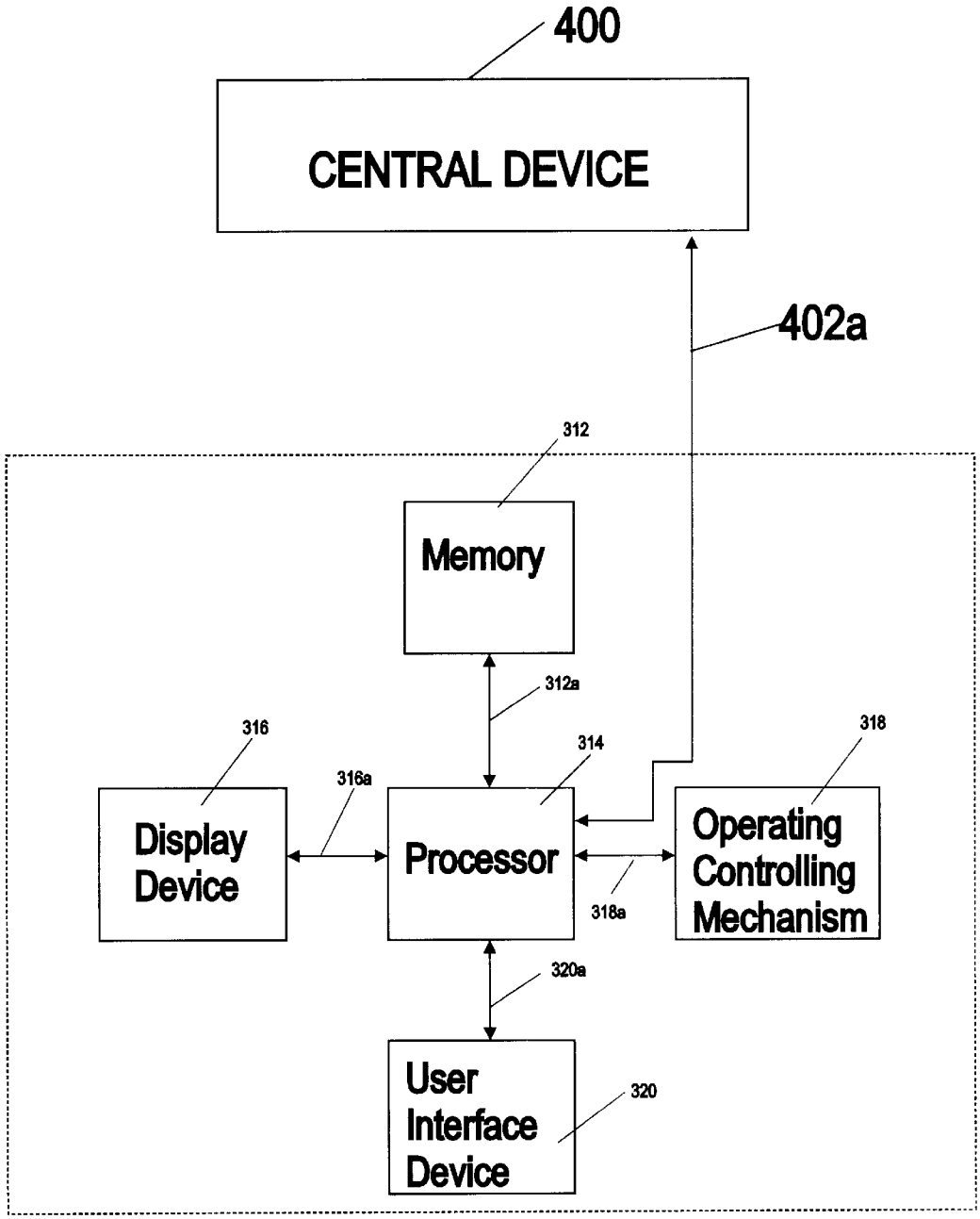
FIG. 4 shows a simplified diagram of a method in accordance with another embodiment of the present invention.

FIG. 4 shows a simplified diagram of another method in accordance with another embodiment of the present invention. FIG. 4 shows apparatus 310, which may be similar to apparatus 10 of FIG. 1 and may be part of a protected device. Apparatus 310 may include memory 312, processor 314, display device 316, operating control mechanism 318, and user interface 320. Memory 312, display device 316, operating control mechanism 318, and user interface 320 are electrically connected to processor 314 by busses 312*a*, 316*a*, 318*a*, and 320*a*, respectively. The apparatus 310 is electrically connected by communications channel 402*a* to a central device 300. The communications channel may be a wireless channel, a cable, or any other type of communications channel.

In one embodiment of the present invention the central device 400 may cause the service for the apparatus 310 to change. For example, if the apparatus 310 is part of a cellular telephone, the central device 400 upon receiving a request to make a long distance call from the apparatus 310, may prevent that long distance call from being made. The central device 400 may send a signal to the apparatus 310 that a call will not be allowed until an access code is entered into the user interface device 320. The processor 314 may include a transmitter/receiver if the communications channel 402*a* is a wireless channel. The processor 314 may send the access code entered by a user into user interface device 320 to central device 400. The central device 400 may verify that the access code entered is the correct code and the central device 400 may resume normal service for the apparatus 310.

The present invention in one or more embodiments may be thought of as providing "invisible" protection. If a consumer knows that a certain type of protected device typically has this invisible protection the consumer will be less likely to purchase a potentially stolen item from a questionable source. If the protection is "probabilistic", through the use of for example periodic and/or randomly generated numbers, then it will be difficult or impossible for a potential buyer to verify whether the protection has been removed or not.

The use of probabilistic methods, for example with the use of randomly generated numbers to determine whether to alter the operation of operation controlling mechanism 18, has at least three advantages. Firstly, it generally reduces the value of the article to a thief, but not to a rightful owner. Secondly, it cannot be detected (or at least is difficult to detect) by a client of the thief, who therefore has to assume that it has not been removed (or trust the thief if he says that it has). Thirdly probabilistic methods allow legal resale without a significant reduction of value since the password code or personal identification number will be given to the buyer with warranty documents, or the new owner can register the consumer device. A thief would not dare to register the device.

The probabilistic technique can be implemented either in computer or electronic hardware or software, and on a variety of platforms. It is not expensive to implement, and increases the value of the protected device to rightful owners by lowering the value to thieves.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

I claim:

1. A method comprised of the steps of:

causing a device to operate normally in a first state without the use of any access code;

causing the device to operate normally in a second state and providing one or more warnings during the second state, the one or more warnings indicating that in order for the device to continue to operate normally an access code must be provided;

wherein a first event triggers the providing of one or more warnings and the operation of the device in the second state; and causing the device to operate other than normally in a third state if the access code is not provided prior to the occurrence of a second event.

2. The method of claim 1 further comprising the steps of:

after the occurrence of the second event, causing the device to transition from operating other than normally in the third state to operating normally in the first state, when the access code is provided during the third state.

3. The method of claim 1 wherein the first event occurs eventually after some random period of time.

4. The method of claim 1 wherein the second event occurs eventually after some random period of time.

5. An apparatus comprising:

means for causing normal operation of a protected device without the use of any access code;

means for altering the normal operation of a protected device;

means for receiving an access code; and wherein the means for altering the normal operation of the protected device alters the normal operation of the protected device if the access code is not received prior to an occurrence of an event.

6. The apparatus of claim 5 wherein the occurrence of the event is the passage of a certain period of time.

7. The apparatus of claim 5 further comprising means for providing one or more warnings prior to the occurrence of the event;

wherein each warning indicates that the operation of the protected device will be altered unless an access code is provided to the means for receiving an access code.

8. The apparatus of claim 7 wherein the means for providing one or more warnings provides warnings in a random manner.

9. The apparatus of claim 8 wherein the means for providing one or more warnings provides a warning to a user when a randomly generated numbers falls within a first range.

10. An apparatus comprising:

a memory;

a processor;

a user interface device;

an operation controlling mechanism;

wherein the operation controlling mechanism controls the operation of a protected device;

wherein the operation controlling mechanism causes normal operation of the protected device without the use of any access codes;

wherein the processor provides a warning to a user that the operation of the operation controlling mechanism will the altered unless an access code is entered into the user interface device;

and wherein the processor alters the operation of the operation controlling mechanism and thereby alters the operation of the protected device, if the access code is not entered into the user interface device.

11. The apparatus of claim 10 wherein the processor provides periodically provides warnings to the user that the operation of the operation controlling mechanism will be altered unless an access code is entered in the user interface device.

12. The apparatus of claim 10 wherein the processor provides a warning to a user when a randomly generated numbers falls within a first range.

13. The apparatus of claim 10 wherein the processor alters the operation of the operation controlling mechanism and thereby alters the operation of the protected device, if the access code is not entered into the user interface device with a certain time period.

14. The apparatus of claim 10 wherein the protected device is a compact disc player.

15. The apparatus of claim 10 wherein the protected device is a camera.

16. The apparatus of claim 10 wherein the protected device is a computer.

17. The apparatus of claim 10 wherein the protected device is a television.

18. The apparatus of claim 10 wherein the protected device is a video cassette recorder.

19. The apparatus of claim 10 wherein the access code is stored in memory.

20. A method comprising the steps of causing normal operation of a protected device without the use of any access code;

providing a warning to a user that the operation of the protected device will be altered from normal operation unless an access code is entered into a user interface device;

partially altering the operation of the protected device, if the access code is not entered into the user interface device prior to the occurrence of a first event; and further partially altering the operation of the protected device, if the access code is not entered into the user interface device prior to the occurrence of a second event.

21. The method of claim 20 further comprising the steps of transitioning the protected device from altered operation back to normal operation if the access code is entered.

22. The method of claim 20 wherein the first event is the passage of a first time period;

and the second event is the passage of a second time period.

23. A method comprising the steps of providing service to a protected device without the use of any access code;

providing a warning to a user that the service for a protected device will be altered unless an access code is entered into a user interface device;

altering the service for the protected device, if the access code is not entered into the user interface device or to the occurrence of an event.

24. The method of claim 23 wherein the event is the passage of a first time period.

25. A method comprising enabling all operations for a protected device without the use of any access code;

providing an access code for entry into a protected device;

wherein the access code when entered into the protected device causes one or more operations of the protected device to be disabled after warning has been provided by the protected device and after the occurrence of an event unless the access code is entered into the protected device after the wang is provided and prior to the occurrence of the event.

26. The method of claim 25 wherein the event is the expiration of a length of time.

27. The method of claim 25 wherein the event is the completion of a number of operations of the protected device.

* * * * *